US005657565A

United States Patent [19]

Dehli

[11] Patent Number: 5,657,565

[45] Date of Patent: Aug. 19, 1997

[54] COMPACT DISPLAY APPARATUS

[75] Inventor: Hans J. Dehli, Dana Point, Calif.

[73] Assignee: Admotion Corporation, Irvine, Calif.

[21] Appl. No.: 575,410

[22] Filed: Dec. 20, 1995

[51] Int. Cl.[6] ..... G09F 11/00

[52] U.S. Cl. ..... 40/476; 40/437

[58] Field of Search ..... 40/436, 437, 442, 40/445, 476, 509, 488

[56] References Cited

U.S. PATENT DOCUMENTS

| | | | |
|---|---|---|---|
| 3,277,597 | 10/1966 | Trame . | |
| 3,683,525 | 8/1972 | Fukui . | |
| 3,747,243 | 7/1973 | Schneider | 40/436 |
| 3,827,797 | 8/1974 | Eaves . | |
| 3,862,504 | 1/1975 | Ringelheim | 40/437 |
| 3,883,966 | 5/1975 | Ludwig . | |
| 3,918,185 | 11/1975 | Hasala | 40/436 |
| 3,928,846 | 12/1975 | Arai et al. . | |
| 4,092,791 | 6/1978 | Apissomian . | |
| 4,118,879 | 10/1978 | Simon | 40/437 |
| 4,142,794 | 3/1979 | Trump . | |
| 4,246,713 | 1/1981 | Eckert . | |
| 4,860,471 | 8/1989 | Bonanomi . | |
| 4,878,086 | 10/1989 | Isohata et al. . | |
| 4,897,802 | 1/1990 | Atkinson et al. . | |
| 5,440,214 | 8/1995 | Peeters . | |
| 5,459,954 | 10/1995 | Bronaugh et al. | 40/437 |

*Primary Examiner*—Kenneth J. Dorner
*Assistant Examiner*—Cassandra Davis
*Attorney, Agent, or Firm*—Fulwider Patton Lee & Utecht, LLP

[57] ABSTRACT

Compact display apparatus for sequentially registering image pixels interlaced on a mosaic and corresponding to discrete images with an aperture pattern on a mask to display such discrete images. A plurality of biasing arms are provided to adjust the mosaic relative to the mask to properly register the image pixels on the mosaic with the apertures on the mask. A drive assembly is provided to displace the mosaic on a dosed loop path to sequentially register the image pixels corresponding with discrete images with the apertures in the mask.

21 Claims, 4 Drawing Sheets

COMPACT DISPLAY APPARATUS

BACKGROUND OF THE INVENTION

1. Field of the Invention

The present invention relates to advertising displays and, more particularly, to a compact display apparatus for sequentially displaying multiple images formed on a single transparency.

2. Description of the Prior Art

With the advent of modem display advertising, limitations on advertising budgets and limited locations for display to high densities of potential customers, a great demand has arisen for display advertising which allows for the display of multiple advertisements at one desirable display location to thereby enable a number of advertisers to benefit from the one location. In addition, it is desirable to provide such a device which may be utilized in relatively confined spaces, such as immediately adjacent to the product or products themselves.

Numerous different methods and devices have been proposed for preparing and displaying such advertisements. Many such devices involve relatively unwieldy mechanical elements driven by complex drive mechanisms which tend to be relatively bulky. Thus such devices will typically be relatively large and expensive to manufacture and therefore not suitable for display in relatively confined areas.

Display devices have been proposed which include generally opaque screens formed with aperture patterns defining numbers, letters or figures to be illuminated by a light source behind such screen. Such devices are disclosed in U.S. Pat. No. 1,172,455 to Hildburgh and in U.S. Pat. No. 4,246,713 to Eckert. However, such devices include no means for sequentially displaying distinct images or advertisements which cover substantially the entire display screen.

There are also prior art devices which include transparent sheets formed with images thereon and which are illuminated by back lighting and cooperate with movable opaque masks including aperture patterns for selectively registering the aperture pattern with one of the images formed on the transparent sheet. Examples of such devices are disclosed in U.S. Pat. No. 4,092,791 to Apissomian and in U.S. Pat. No. 3,918,185 to Hasala. These devices are not free from shortcomings, however. In the first place, the devices incorporate relatively complex drive assemblies in order to sequentially align the various images on the sheets with the aperture pattern on the masks. In addition, no means is provided for efficiently adjusting the mask relative to the transparent sheet in the event the mask and sheet are not in proper registration with one another.

Yet another device which includes a translucent image screen comprising a mosaic of discrete images formed by relatively small translucent pixels interlaced and arranged in uniform groups for sequential alignment with an aperture pattern formed on a stationary mask is disclosed in U.S. Pat. No. 4,897,802 to Atkinson et al., assigned to the assignee of the present application. The device exhibits excellent operational characteristics. However, the device incorporates a drive motor mounted at each of the respective corners of the apparatus for displacing the mosaic relative to the grid mask to sequentially display the discrete images formed on the mosaic. In addition, no means is provided for efficiently adjusting either the mask or mosaic relative to one another in order to conveniently align the mask and mosaic in the event the mask and mosaic are not properly aligned.

Still another prior art device designed for sequentially displaying a plurality of images formed on one sheet is disclosed in U.S. Pat. No. 5,440,214 to Peeters, likewise assigned to the assignee of the present invention. The device disclosed in the patent is a low cost, efficient apparatus that provides for the sequential display of multiple high resolution images in a fast and accurate manner. This device, while having been well received commercially is relatively expensive to manufacture and presents some challenge to adjustment and maintenance of alignment.

As such, it will be appreciated that there continues to be a need for a compact display apparatus which is inexpensive to manufacture and allows for efficient manual adjustment in order to maintain the mosaic and mask in proper spatial relation to allow for precise registration of the images on the mosaic with the aperture pattern on the mask as one of the two is displaced relative to the other. The instant invention addresses such needs.

SUMMARY OF THE INTENTION

Briefly, and in general terms, the present invention is directed to a compact display apparatus which provides an adjustment assembly for maintaining the mosaic and mask in proper spatial relation relative to one another. The apparatus includes a frame assembly comprising a main frame which mounts a substantially opaque mask thereon and an adjustable platen frame floatably carried within the main frame and mounting a mosaic thereon beneath the mask. The main frame includes an upstanding peripheral side wall formed with a plurality of apertures disposed in predetermined positions therealong. The platen frame includes a plurality of biasing arms projecting outwardly from the platen frame and terminating in threaded bores at the respective distal ends thereof. The biasing arms are spaced apart on the platen frame in predetermined locations such that with the platen time floatably carried within the main frame, the threaded bores formed in the respective distal ends of the biasing arms will be precisely aligned with the respective apertures formed in the peripheral side wall of the main frame. A plurality of adjustment screws may be extended through the respective apertures and engaged with the respective threaded bores to allow for efficiently adjusting the platen frame relative to the main frame.

The apparatus of the present invention may further include a pair of eccentric drives rotatably mounted on the opposite sides of the platen frame and including eccentrically disposed, upwardly opening bores which house therein ball beatings to allow for mounting the mosaic on the eccentric drives. A motor is provided and is connected to the eccentric drives to rotate same and thus displace the mosaic in a generally circular path to sequentially register the discrete images on the mosaic with the apertures on the mask.

DETAILED DESCRIPTION OF THE PREFERRED EMBODIMENT

Figure 1:
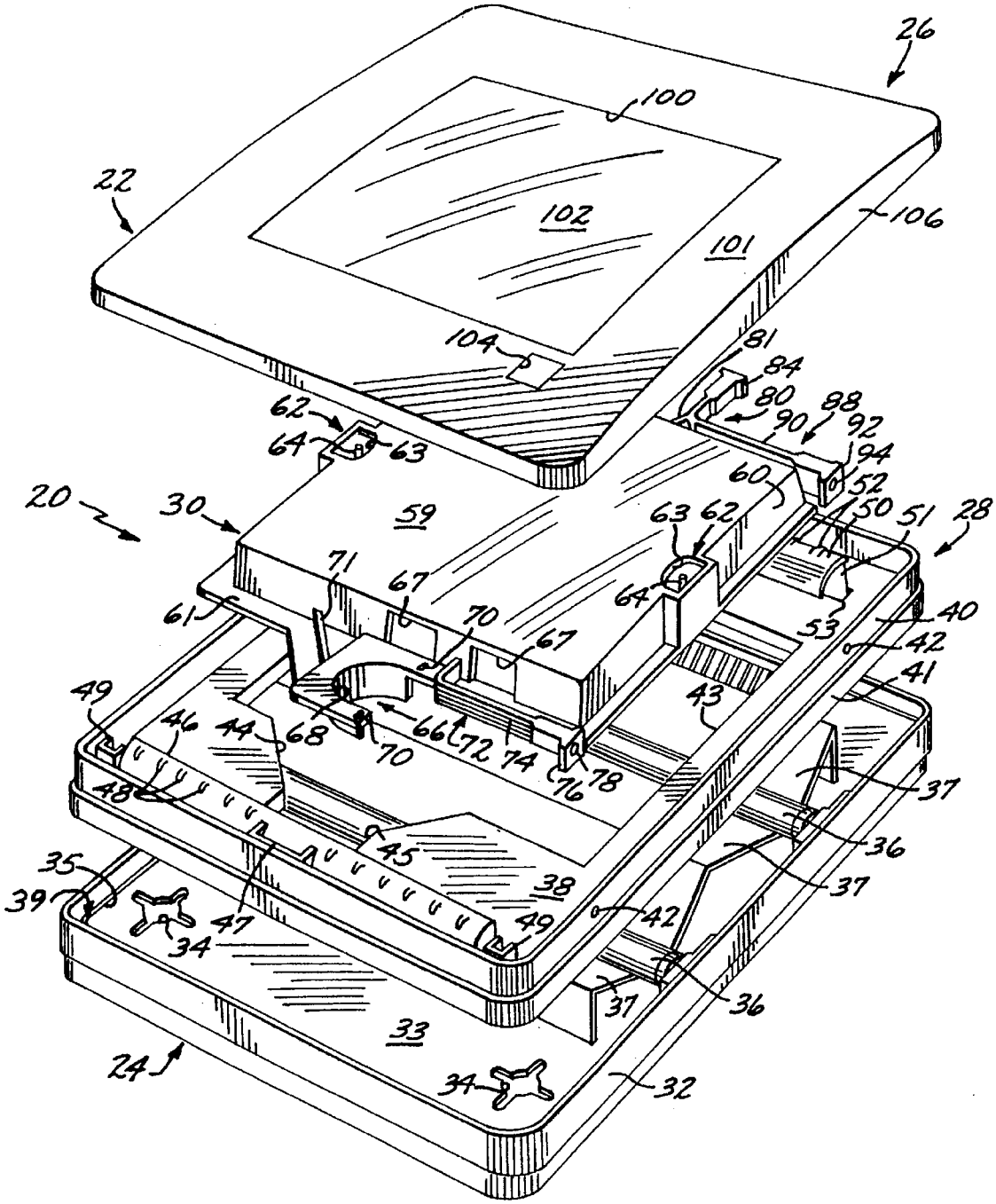
FIG. 1 is an exploded perspective view of a compact display apparatus embodying the present invention.
Figure 4:
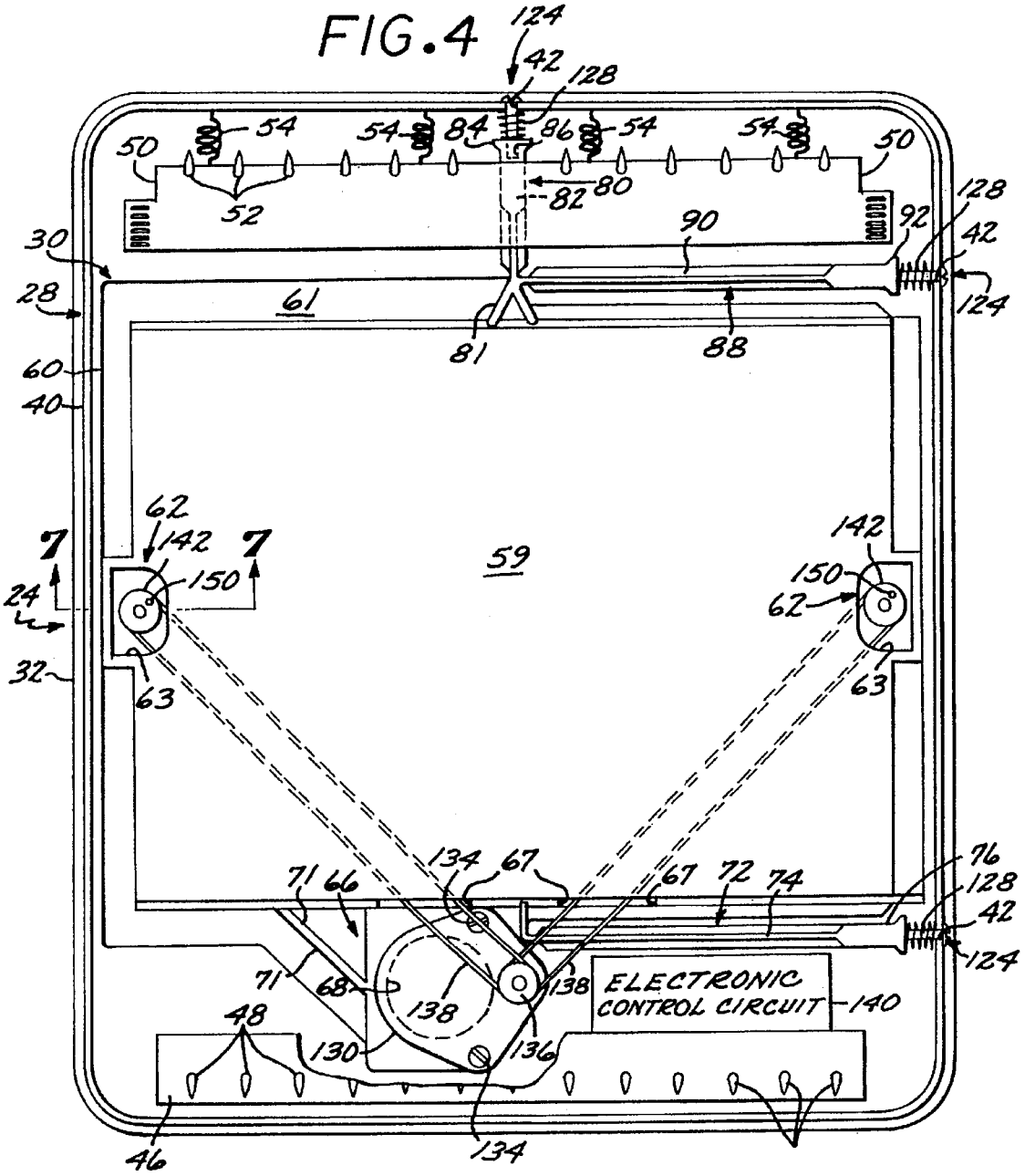
FIG. 4 is a horizontal cross-sectional view, in enlarged scale, of the apparatus shown in FIG. 1.

In the following detailed description, like reference numerals will be used to refer to like or corresponding elements in the different figures of the drawings. Referring now to the drawings, and particularly to FIGS. 1 and 4, there is shown generally a compact display apparatus 20 embodying the present invention. The compact display apparatus comprises, generally, a housing 22 including a pan 24 and a cover 26. The housing houses therein a frame assembly comprising, generally, a main frame 28 and a platen frame 30 floatably carried within the main frame. The platen frame includes a plurality of resilient, spaced apart biasing arms 72, 80 and 88 projecting cantileverly from the respective sides thereof for connection at their respective distal ends with the main frame to provide for flexing thereof to allow the platen frame to be displaced relative to the main frame. The platen frame rotatably mounts on the opposite sides thereof a pair of eccentric drives 142 including eccentrically disposed, upwardly opening bores 146. The eccentric drives are rotated by means of a gear motor 130 which drives a pair of drive belts 138 in communication with the respective eccentric drives. A mosaic 116 comprising a plurality of interlaced pixels from a plurality of discrete images is provided and includes a pair of spaced apart mounting bores 120 for releasable mounting on the respective eccentric drives. A generally opaque mask 110 including a uniform aperture pattern formed thereon is mounted on the main frame outward of the mosaic to provide for sequential registration of the image pixels corresponding to the discrete images formed on the mosaic with the aperture pattern on the mask as the mosaic is displaced relative to the mask during rotation of the eccentric drives.

Display devices of the type which sequentially display discrete images formed on one mosaic are not always free from undesirable operational characteristics. One typical undesirable characteristic is that after properly aligning the mosaic with the mask and operating the apparatus for some time, the mask and mosaic may become slightly misaligned. This will cause the apertures of the mask to be aligned with portions of image pixels corresponding with multiple images rather than with the pixels of only one image, causing the device to display a blurred double image. In relatively compact display apparatus, due to the relatively small dimensions of the image pixels and the apertures on the mask as well as the close proximity of the viewer of the display, even the slightest degree of misalignment can result in the undesirable display of a distorted double image. The present invention provides an apparatus which may be conveniently and efficiently adjusted in the event the mask and mosaic should happen to become misaligned.

Figure 2:
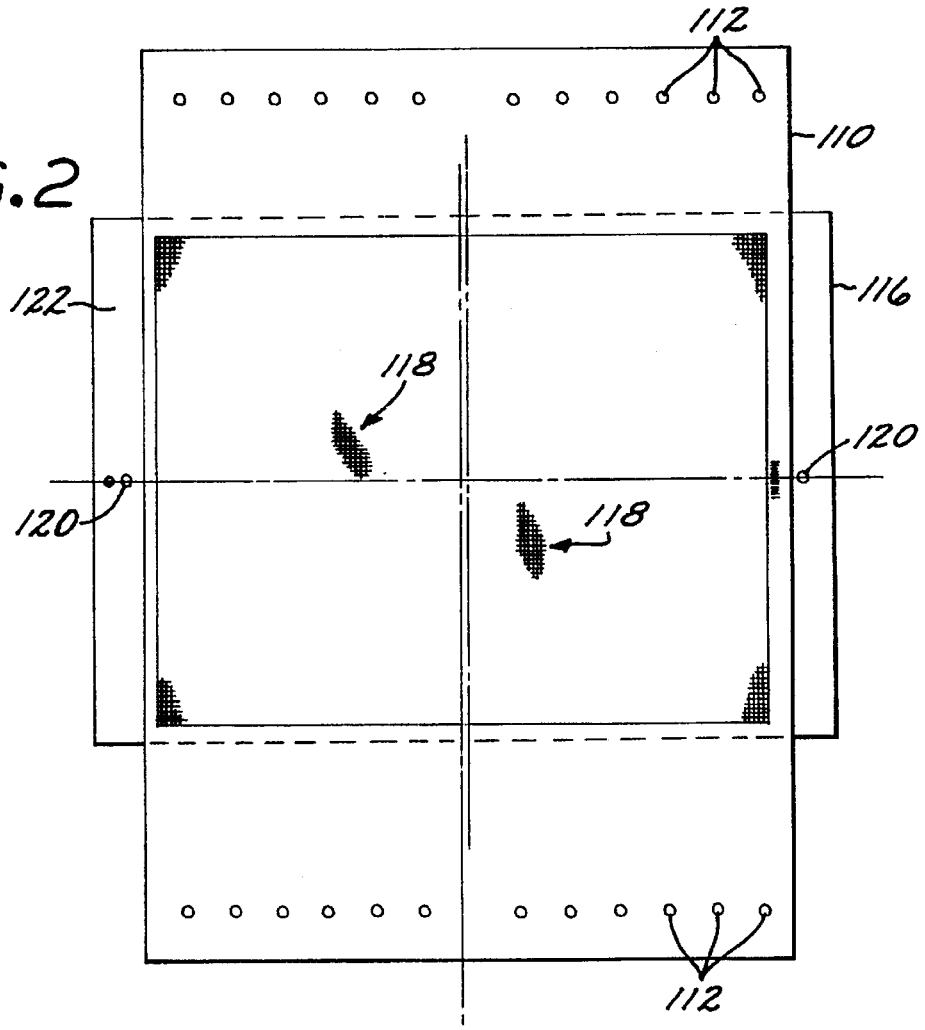
FIG. 2 is a top plan view of a transparent mosaic and substantially opaque mask included in the apparatus of the present invention.
Figure 3:
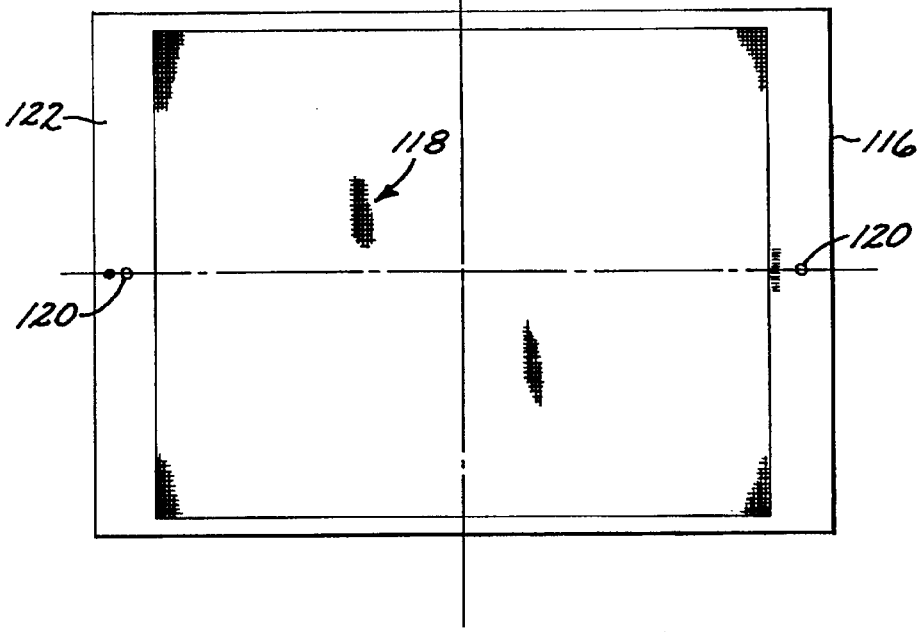
FIG. 3 is a top plan view of the mosaic shown in FIG. 2.

Referring to FIGS. 2 and 3, there is shown the mask 110 and mosaic 116. The mask 110 is generally rectangular and has an opaque grid work formed thereon defining a predetermined pattern of apertures spaced uniformly thereabout to block light from projecting through approximately 75% of the area of the mask. The apertures are squares with sides of 0.028 inches in length. The mask is further formed with a pair of rows of laterally spaced apart bores 112 formed adjacent the opposite longitudinal ends of the mask, such bores defining mounting bores for releasably mounting the mask on the main frame 28 as described in greater detail below.

The mosaic 116 is likewise generally rectangular and includes a plurality of image pixels 118 from a plurality of discrete images interspersed in a uniform pattern over the mosaic corresponding with the aperture pattern formed on the mask 110. The mosaic may be of the type shown in U.S. Pat. No. 4,897,802 to Atkinson and assigned to the assignee of the rights in the instant invention. In the preferred embodiment, the sheet is photographically prepared to form four discrete images formed from sets of pixels corresponding with the discrete images interlaced with other sets of pixels corresponding with other discrete images. Each pixel is square with dimensions of 0.028 inches on a side. Thus each square four pixel group includes one pixel from each of the four images in a predetermined uniform position and has a dimension of 0.056 inches on a side. Thus the mask may be placed over the mosaic and one of the two shifted relative to the other to register the apertures on the mask with the image pixels 118 on the mosaic corresponding with one of the discrete images formed on the mosaic to display such image. Such relative shifting may be continued to sequentially register the apertures on the mask with the respective sets of pixels corresponding with the various discrete images interspersed on the mosaic.

Although the pixel sizes on the mosaic 116 are 0.028 inch squares to correspond with the size of the apertures formed on the mask 110, in the preferred method of manufacturing the mosaic the pixels are formed as 0.030 inch squares and are formed next to the adjacent pixel with a 0.001 inch overlap. This has been found to substantially eliminate what is referred to as "white flash". Often as a mosaic is displaced relative to a mask in order to register a new image with the aperture pattern formed on the mask, the typically white borders of the image pixels will temporarily register with the aperture pattern, causing the emission from the device of a brilliant white light or "white flash" which can have the effect of causing viewers of the display to turn away from and cease viewing the display. It has been found that by slightly overlapping the adjacent image pixels, the "white flash" which would otherwise occur between the display of discrete images is eliminated such that the viewer of the display is more likely to continue viewing the display as a new image is displayed.

The pan 24 is generally rectangular in cross-section and includes an upstanding peripheral side wall 32 extending upwardly from a planar plate 33. The base further comprises an upstanding wall 35 disposed inwardly of the peripheral side wall. The respective walls cooperate to define therebetween a peripheral, upwardly opening groove, generally designated 39, for receipt therein of the main frame 28 as described in greater detail below. The pan mounts therein a pair of spaced apart light tubes 36 interposed between a plurality of longitudinally projecting, triangularly shaped reflectors 37 which extend, at their respective apexes, outwardly above the plane of the outermost peripheries of the respective tubes to thus protect the tubes from being struck when the main frame is manipulated about during assembly. The plate is formed with spaced apart cruciform mounting holes 34 disposed in the four corners thereof for conveniently mounting the display apparatus 20 in an out of the way location such as on a wall from a nail, hook or the like.

The cover 26 is generally rectangular in cross-section and includes a domed upper face 101 formed with a square opening defining a window 100 having a lens 102 therein through which the mosaic 116 may be viewed (FIG. 1). The cover further includes a second, smaller square opening 104 spaced from one corner of the window 100. The cover includes a downwardly projecting peripheral skirt 106 having cross-sectional dimensions slightly greater than that of the upstanding peripheral side wall 32 for slidable extension downwardly thereover. A plurality of deflectable, curved, downwardly projecting hooks (not shown) are formed in spaced apart relation on the inner face of the cover for engagement with respective spaced apart upstanding latches 49 formed on the main frame 28 to conveniently and securely yet releasably connect the cover with the main frame.

The main frame 28 is generally rectangular in cross-section and is formed with a planar platen tray 38 carried medially from a vertically projecting peripheral rim 41 having slightly smaller dimensions in its bottom extremity than that of the upstanding side wall 32 for extension downwardly into the peripheral groove 39 formed in the base to securely house the main frame in the base. Such rim 41 is formed in its upper extremity with an upstanding peripheral lip 40 projecting upwardly from the platen tray and formed in its opposite sides with a plurality of spaced apart bores 42. The platen tray has formed therein a generally rectangular opening 43 for registration above the light tubes 36 housed in the base 24. The opening connects at one longitudinal end thereof with a generally trapezoidal shaped opening 44 terminating in a reduced in dimension rectangular opening 45 for extension therethrough of the gear motor 130 as described in greater detail below.

The main frame 28 houses at one longitudinal end thereof a laterally extending lower mask holder 46 including a plurality of pointed projections 48 formed on the upper end thereof and projecting generally tangentially therefrom (FIGS. 1 and 4). The lower mask holder is fixedly attached to the main frame by means of a generally U-shaped bracket 47. Disposed at the opposite longitudinal end of the main time is a laterally extending upper mask holder and tensioner 50, likewise including a plurality of pointed projections 52 formed on the upper end thereof and projecting generally tangentially therefrom. The upper mask holder and tensioner is formed at its lower end with a plurality of downwardly and inwardly tapering segments 51 terminating in laterally extending cylindrical rods (not shown) for extension through respective slots 53 formed in the base and for releasable engagement with respective pairs of opposing, deflectable, downwardly extending tabs (not shown) connected to the opposite laterally extending ends of the respective slots to pivotally mount the mask holder and tensioner on the main frame. Thus the mask holder and tensioner may pivot to a degree dictated by the width of the respective slots and of the respective downwardly and inwardly tapering segments. A plurality of biasing springs 54 (FIG. 4) releasably connect to the mask holder and tensioner and to the inner face of the upstanding lip 40 and serve to bias the mask holder and tensioner toward such inner face. Thus the bores 112 formed in the opposite ends of the mask 110 may be engaged with the respective projections 48 and 52 on the mask holder 46 and on the mask holder and tensioner 50 such that the biasing springs tend to pull the mask holder and tensioner away from the mask holder to tightly mount the mask over the main frame.

The platen frame 30 is generally rectangular in cross-section and includes a generally upstanding peripheral wall 60 connected at its bottom end with an outwardly flared base 61. The upstanding peripheral wall connects at its upper end with a planar, transparent or translucent platen 59 which supports thereon the mosaic 116 and allows for the projection therethrough of light from the light tubes 36 to illuminate the mosaic as described in greater detail below. Formed in the opposite lateral sides of the platen frame are a pair of eccentric drive mounts, generally designated 62, including respective cut-outs 63 formed in the platen in which are securely placed respective upstanding mounting shafts 64. Connected to one longitudinal end of the platen frame is a motor mounting bracket, generally designated 66, formed with a semi-circular cut-out 68 and including a pair of spaced apart threaded bores 70 (FIG. 1). A support arm 71 projects from the peripheral wall 60 at an angle and connects to one end of the bracket. Formed in the peripheral wall 60 adjacent the motor mounting bracket are a pair of rectangular openings 67 for extension therethrough of respective drive belts as discussed in greater detail below.

Referring to FIGS. 1 and 4, the platen frame 30 is further formed with the respective resilient, spaced apart biasing arms 72, 80, and 88 molded in one piece with the platen frame. The biasing arm 72 is generally L-shaped to form a mounting stem projecting perpendicular from the side of the platen frame and then rams perpendicularly to parallel one longitudinal end of the platen frame to terminate in an outwardly flared mounting boss end 76 formed with an axial threaded bore 78.

The biasing arm 80 is formed with an orthogonal spacer arm 82 carried from the platen frame by a V-shaped bracket 81. The spacer arm 82 terminates at its distal end in an outwardly flared mounting boss end 84 formed with an axial threaded bore 86 (not shown). The biasing arm 88 projects laterally from one side of the bracket 81 to project parallel to the peripheral platen wall 60 to terminate in an outwardly flared mounting boss end 92 formed with a threaded bore 94 therein (FIG. 4).

Figure 5:
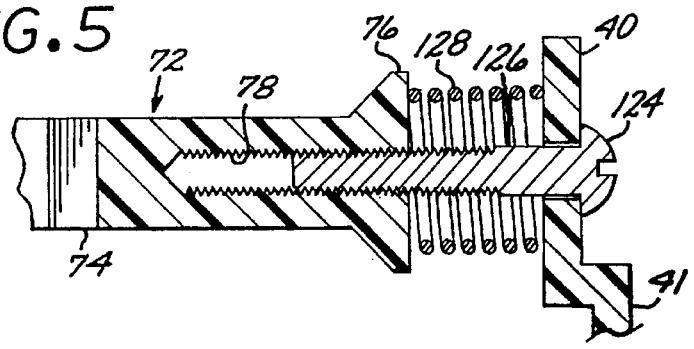
FIG. 5 is a fragmented cross-sectional view, in enlarged scale, taken along the line 5—5 of FIG. 4.

The respective biasing arms 72, 80, and 88 are disposed in predetermined positions on the platen frame 30 for alignment of the respective threaded bores 78, 86 and 94 with the respective bores 42 formed in the upstanding peripheral lip 40. Thus, with the platen frame floatably carried on the platen tray, a plurality of adjustment screws, generally designated 124, may be extended through the respective bores 42 and through bias spring 128 to engage the threaded axial bores 78, 86 and 94 formed in the respective flared ends of the biasing arms (FIGS. 4 and 5) to provide for travel of such platen relative to the housing.

The respective extensions 74, 82, and 90 are formed of a flexible, resilient material such as plastic to allow for flexing of such extensions when subjected to a bias to assume a curved configuration and to return to their unbiased shape when such bias is removed. Thus if the biasing arms 72 and 88 are adjusted to displace the platen frame 30 in a lateral direction within the main frame 28, the biasing arm 82 will bend slightly to compensate for such displacement, and vice versa, all the while tending to urge the platen back to its neutral position.

Thus it will be appreciated that the respective biasing arms 72, 80 and 88 provide a convenient and efficient means for centering the platen and allowing for adjustment of the display apparatus 20. In the event the mosaic 116 and mask 110 are not properly aligned as the mosaic is displaced relative to the mask, an operator may simply manipulate one or more of the adjustment screws 124 to displace the platen frame 30 relative to the main frame 28 in either a lateral or longitudinal direction, or both, until the mosaic assumes the proper position relative to the mask.

The display apparatus 20, in top plan view, has dimensions of approximately 10"×12", and thus is suitable for placement in virtually any confined space such as on a display counter immediately adjacent the product being displayed by the apparatus.

Figure 6:
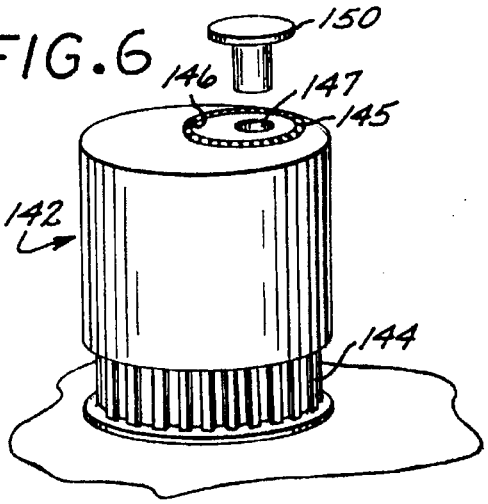
FIG. 6 is an exploded perspective view, in enlarged scale, of an eccentric drive included in the present invention.
Figure 7:
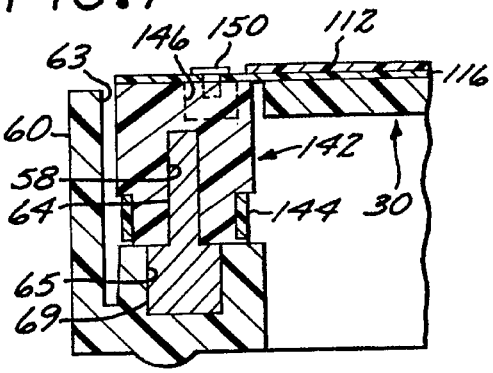
FIG. 7 is a fragmented cross-sectional view, in enlarged scale, taken along the line 7—7 of FIG. 4.
Figure 8:
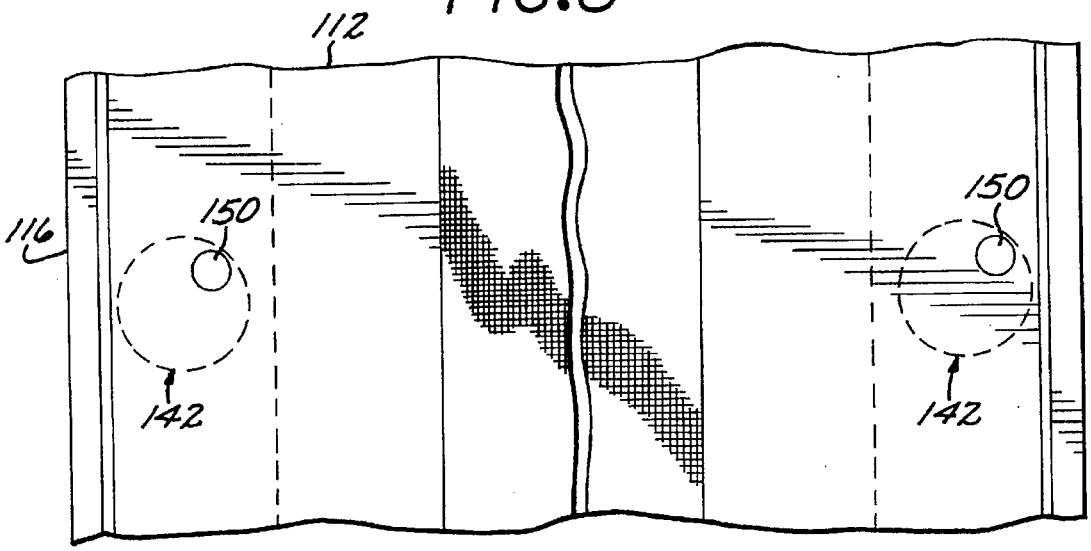
FIG. 8 is a fragmented top plan view, partially in phantom, of the present invention.
Figure 9:
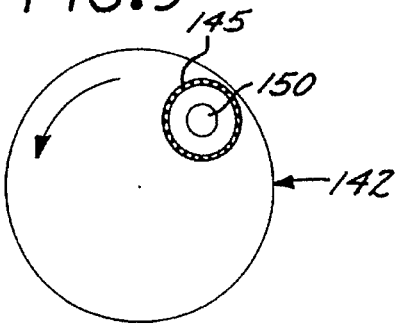
FIG. 9 is a top plan view of the eccentric drive shown in FIG. 6.

With reference to FIGS. 4, 6, and 7, the eccentric drives 142 are in the form of wheels rotatably mounted on the upstanding mounting shafts 64 disposed within the respective cut-outs 63, and formed with eccentrically disposed drive pins 150. The respective eccentric drives are molded in one piece to form downwardly opening bores 58 (FIG. 7) for slidable receipt over the respective mounting shafts to provide for free rotation thereon. An eccentrically disposed counterbored bore 146 is formed in the upwardly facing ends of the respective drives and is offset from the rotational axis of the respective drives by a distance corresponding with approximately one-half the cross-sectional dimension of the image pixels formed on the mosaic 116. Press fit into the eccentric bore is the outer race of a ball bearing assembly 145 offset 0.019 inches relative to the shaft bushing. Thus, as the eccentric drive is rotated, the drive pin may rotate independently of the eccentric drive and will be displaced along a closed loop circular path with a diameter of 0.039 inches. Formed in the periphery of the respective drives adjacent the bottom ends thereof are respective toothed gears 144 for meshing with the teeth of respective timing drive belts as discussed in greater detail below.

Figure 10:
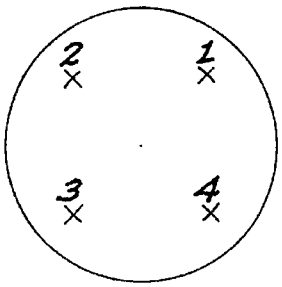
FIG. 10 is a schematic diagram depicting the various positions of the eccentric drive as it is displaced through its path of rotation.

The eccentric drives 142 are thus constructed with respective eccentric bores 146 having an eccentricity slightly greater than one-half the width of the respective image pixels formed on the mosaic 116 so that the respective drive pins 150 and thus the mosaic 116 are orbited through a circle having a diameter slightly greater than the width of a full pixel. The positions of the eccentric drive corresponding with the precise registration of the image pixels of the various discrete images formed on the mosaic with the aperture pattern formed in the mask may be characterized as positions 1, 2, 3 and 4 as shown in FIG. 10. The linear distance between positions 1 and 2, positions 2 and 3, and positions 3 and 4 is 0.028 inches to correspond with the width of the image pixels on the mosaic. Thus with the eccentric drive in position 1 the image pixels corresponding with a first discrete image formed on the mosaic will register with the aperture pattern formed in the mask to display the image comprising such image pixels. The eccentric drive is then rotated through an arcuate path to be displaced through an angle of 90 degrees to position 2. It will be appreciated that such a degree of rotation will result in the displacement of the mosaic 0.028 inches to the left as shown in FIG. 10 to shift the mosaic relative to the mask to a degree sufficient to register the image pixels corresponding with a second discrete image formed on the mosaic with the apertures in the mask to display the second composite image. The process is then continued to sequentially display the composite images corresponding with the pixels which will be registered with the apertures in the mask as the eccentric drive is driven to positions 3 and 4 in FIG. 10. As the eccentric drives are driven from position 2 to position 3, the mosaic will be shifted downwardly 0.028 inches as shown in FIG. 10 to register the image pixels of a third discrete image formed on the mosaic with the apertures on the mask. As the eccentric drives are driven from position 3 to position 4, the mosaic will be shifted 0.028 inches to the right as shown in FIG. 10 to register the image pixels of a fourth discrete image formed on the mosaic with the apertures on the mask. After the image corresponding to position 4 is displayed, it will be appreciated that the eccentric drive will be displaced another 90 degrees to shift the mosaic 0.028 inches upwardly as shown in FIG. 10 to return to position 1 to repeat the process.

The eccentric drives 142 are further formed with respective indicator marks 149 formed on the respective upwardly facing ends thereof. Such indicator marks allow the operator to quickly determine position 1 as described above.

With reference to FIG. 4, there is shown the gear motor 130 in place mounted on the mounting bracket 66 and extending through the bores 44 and 45 formed in the main frame 28. The motor is securely mounted on the bracket by means of a pair of screws 134 which threadably engage the respective threaded bores 70 formed on such bracket. In the alternative, the bracket could be formed with a pair of opposing, inwardly concave arms configured for grasping the opposite sides of the motor, such arms terminating in respective opposing, parallel mounting plates which may be connected by means of a screw or other such fastener to securely mount the motor on the platen frame. The gear motor drives a rotatable shaft (not shown) which is engaged with a double-grooved drive pulley 136. A pair of timing drive belts 138 pass over the respective grooves of the pulley and pass through the respective drive belt openings 67 formed in the upstanding wall 60 of the platen frame to pass over the toothed peripheries 144 of the respective eccentric drives 142. Thus operation of the gear motor serves to rotate the respective eccentric drives and thereby displace the lock caps 150 on a closed loop circular path.

It is important that the drive belts 138 are substantially inelastic and are formed with respective sets of teeth to mesh with the respective teeth formed on the drive pulley 136 and with the toothed peripheries 144 formed on the eccentric drives 142 to positively translate the precise biasing of the drive pulley to the respective eccentric drives.

With further reference to FIG. 4, an electronic control unit 140 such as that disclosed in my pending utility application, Ser. No. 08/153,127 filed Nov. 15, 1993, may be provided to selectively empower the gear motor 130 for predetermined periods of time to rotate the respective eccentric drives 142 and thus displace the mosaic 116 relative to the mask 110 a predetermined distance to register the image pixels of one of the discrete images on the mosaic with the apertures on the mask. Once such registration is achieved, the control unit acts to temporarily deactivate the gear motor so that the image will be displayed for some preselected amount of time. After the preselected amount of time has elapsed, the electronic control unit automatically empowers the gear motor to again rotate the eccentric drives and thus displace the mosaic to register the image pixels corresponding with the next discrete image formed on the mosaic with the apertures on the mask. This sequence is continued to sequentially register the discrete images on the mosaic with the aperture pattern on the mask.

It will be appreciated that other means may be employed to temporarily cease displacement of the mosaic at predetermined positions for sequentially displaying the images on the mosaic. For example, a stepper motor could be used and programmed to stop at the desired locations for sequential display of the discrete images formed on the mosaic.

In operation, a user may remove the cover 26 of the housing 22 from the display apparatus 20 and remove the mask 110 from the mask holder 46 and mask holder and tensioner 50. A mosaic 116 comprising the images which the user wishes to display is then placed in overlying relation on the platen frame 30 so that the follower bores 120 on the mosaic are aligned with the eccentric bores 146 formed on the respective eccentric drives 142. The lock pins 150 are then extended through the follower bores and press fit into the inner races of the respective ball bearing assemblies 145 to overlie the platen frame. The user will then mount the mask 110 over the mosaic by placing the mask over the mosaic and extending the pointed projections 48 and 52 on the mask holder 46 and mask holder and tensioner 50 through the bores 112 formed on the opposite sides of the mask such that the mask holder and tensioner tightly holds the mask in position over the mosaic. The user may then adjust the respective adjustment screws 124 to displace the respective biasing arms 72, 80 and 88 and thus the platen frame 30 relative to the main frame 28 and the mosaic relative to the mask as needed to thereby move the mosaic into position registering the image pixels of one discrete image with the apertures on the mask to thus display the composite image defined by such pixels. In addition, the operator may use the indicator marks 149 to properly align the mosaic and mask.

The user may then actuate the gear motor 130 to rotate the respective eccentric drives 142 and thus displace the mosaic 116 on a closed loop circular path to register the respective image pixels corresponding with the second discrete image formed on the mosaic with the apertures on the mask. During such operation, the gear motor can be temporarily deactivated at one or more dwell points in any manner well known in the art so as to position the image for some selected amount of time for viewing thereof. One control system acceptable for this purpose incorporates a stepper motor as described above to automatically dwell at the four preselected positions corresponding with the display of each of the respective images formed on the mosaic.

After extended use of the compact display apparatus 20, the mosaic 116 may tend to shift slightly relative to the mask 110 to thus become slightly misaligned with the mask in either the lateral or longitudinal direction or both. In this event, the display apparatus will display a blurred double image. To efficiently correct this undesirable result, the user simply needs to deactivate the motor 130 and adjust one or more of the respective biasing arms 72, 80 and 88 to displace the platen flame 30 within the main frame 28 and thus displace the mosaic carried on the platen frame relative to the mask carried on the main frame to bring the image pixels on the mosaic corresponding with one discrete image formed thereon into precise registration with the apertures formed in the mask. The motor may then be reactuated to continue the sequential display of the images on the mosaic.

From the foregoing, it will be appreciated that the compact display apparatus of the present invention incorporates relatively few components and is relatively inexpensive to manufacture, all the while being relatively compact for convenient installation in confined spaces such as on a counter immediately adjacent the product being displayed. In addition, the apparatus of the present invention provides an efficient and convenient means for adjusting the device in the event the mosaic and mask become misaligned relative to one another.

While a particular form of the present invention has been illustrated and described, it will also be apparent that various modifications can be made without departing from the spirit and scope of the invention. Accordingly, it is not intended that the invention be limited, except as by the appended claims.

What is claimed is:

1. Display apparatus for sequentially displaying sets of image pixels corresponding with discrete images interlaced on a transparent mosaic through an aperture pattern formed in a substantially opaque mask and comprising:

a main frame including a platen tray, a plurality of arm mounts, and a mask holder assembly for releasably mounting said mask thereon;

a platen frame floatably carried on said tray and including a platen member and a plurality of elongated, resilient spaced apart biasing arms projecting from said platen frame for connection to the respective said mounts to bias said platen frame to a selected position relative to said main frame;

at least one adjustment device on said main frame for, upon adjustment thereof, adjusting the position of said platen member relative to said main frame against the bias of said arm; and an eccentric drive assembly mounted on said platen frame and including a mounting assembly for mounting said mosaic thereon and operative to drive said mosaic in a predetermined path corresponding with said aperture pattern whereby said opaque mask may be mounted on said mask holder assembly, said mosaic mounted on said eccentric drive assembly and said adjustment device adjusted to adjust said platen member relative to said main frame, said mosaic to be driven through said predetermined path to selectively align corresponding components of said images with the respective said apertures.

2. The apparatus of claim 1 wherein:

said platen frame is rectangularly shaped and is formed with opposite, parallel sides; and the respective said biasing arms are carried cantileverly from their respective one ends centrally on the respective said sides.

3. The apparatus of claim 2 wherein:

said biasing arms project from the respective said one ends and turn to project parallel to the respective said sides.

4. The apparatus of claim 1 wherein:

said platen frame and biasing arms are constructed of plastic.

5. The apparatus of claim 1 wherein:

said platen frame and biasing arms are formed integral with one another.

6. The apparatus of claim 1 wherein:

said platen member is translucent.

7. The adjustable frame assembly of claim 1 further including:

said opaque mask formed with a plurality of spaced apart mounting bores; and said mask holder assembly comprises a pair of mask holders disposed at opposite ends of said main frame and including a plurality of pointed projections for engaging the respective said mounting bores.

8. The adjustable frame assembly of claim 7 wherein:

one of said mask holders is pivotally mounted on said main frame and further including:

a plurality of biasing springs connected to at least one of said mask holders and to said main frame to bias said at least one of said mask holders toward said main frame.

9. The adjustable frame assembly of claim 1 further including:

a housing said main frame and platen frame therein; and a light source housed in said housing for illuminating said mosaic.

10. Display apparatus for sequentially displaying sets of image pixels corresponding with discrete images interlaced on a single mosaic transparency and comprising:

a frame assembly including a main frame comprising a platen tray, a plurality of arm mounts, and a mask holder assembly, said frame assembly further including an adjustable platen frame floatably carried on said tray and including a transparent platen and a plurality of elongated, resilient spaced apart biasing arms projecting outwardly from said platen frame for connection to the respective said arm mounts to bias said platen frame to a selected position relative to said main frame;

at least one adjustment device on said main frame for, upon adjustment thereof, adjusting the position of said transparent platen relative to said main frame against the bias of said arm;

a pair of eccentric drives rotatably mounted on said platen frame and including a mounting assembly for mounting said mosaic thereon;

a mask sheet mounted on said mask holder assembly and comprising a plurality of vertical and horizontal opaque grid lines in spaced relation to form a plurality of square shaped transparent apertures for selective alignment with one of said sets of image pixels formed on said mosaic; and a motor connected to the respective said eccentric drives and operative to actuate said eccentric drives to displace said mosaic relative to said mask sheet in a predetermined path corresponding with said apertures to sequentially register said images on said mosaic with said apertures in said mask sheet.

11. The display apparatus of claim 10 further including:

a housing for housing said frame assembly, eccentric drives, and motor therein.

12. The display apparatus of claim 11 further including:

a light source housed in said housing for illuminating said mosaic.

13. The display apparatus of claim 10 wherein:

said motor includes a double-grooved drive pulley and further including:

a pair of drive belts passing over said pulley and over the respective said eccentric drives.

14. The display apparatus of claim 10 wherein:

said mounting assembly comprises a pair of upwardly opening eccentric bores formed in the respective said eccentric drives, a pair of ball bearing assemblies housed in said eccentric bores, and a pair of lock caps configured for press fitting into said ball beating assemblies.

15. The display apparatus of claim 10 wherein:

said mask is formed with a plurality of mounting bores and wherein:

said mask holder assembly comprises a pair of mask holders mounted at opposite ends of said main frame and including a plurality of spaced apart pointed projections formed thereon for engaging said mounting bores to mount said mask sheet thereon.

16. The display apparatus of claim 10 wherein:

said platen frame includes a pair of spaced apart, cylindrical upstanding mounting shafts; and said eccentric drives include centrally disposed downwardly opening bores for engaging the respective said mounting shafts to rotatably mount said eccentric drives thereon.

17. Display apparatus for sequentially displaying sets of image pixels corresponding with discrete images interlaced on a transparent mosaic sheet through an aperture pattern corresponding with the location of apertures formed in a substantially opaque mask sheet wherein at least one of said sheets is moveable through a predetermined path relative to the other of said sheets to sequentially register said apertures with said sets of image pixels, said apparatus comprising:

a frame assembly including a main frame comprising a platen tray, at least one arm mount, and a mask holder assembly for mounting said mask sheet thereon;

a platen frame floatably carried on said tray and including a translucent platen; a mounting assembly for mounting said mosaic thereon, at least one elongated, resilient biasing arm projecting outwardly from said platen frame for connection to said arm mount to carry said platen frame from said main frame and normally bias said platen frame to a selected position relative to said main frame;

an adjustment device on said main frame for adjusting the position of said platen frame against the bias of said biasing arm; and a drive assembly mounted on said frame assembly, engageable with said at least one sheet and operative to drive said at least one sheet through said predetermined path to sequentially register said sets of image pixels with said apertures in said mask sheet.

18. The apparatus of claim 17 wherein:

said main frame, platen frame and biasing arms are constructed of plastic.

19. The apparatus of claim 17 wherein:

said platen frame and biasing arms are formed integral with one another.

20. The apparatus of claim 17 further including:

a housing said main frame and platen frame therein; and a light source housed in said housing and operative to illuminate said mosaic.

21. The apparatus of claim 17 wherein:

said main frame is rectangular and includes a pair of said arm mounts disposed along one side thereof and a third said arm mount on an orthogonal side;

said platen frame includes a pair of said resilient biasing arms on opposite sides of said platen frame formed integral therewith and connected on their distal ends with said pair of arm mounts and a third resilient biasing arm projecting toward said third mount; and said adjustment device includes adjustment screws on said main frame and threadably engaged with the respective said biasing arms.

* * * * *

UNITED STATES PATENT AND TRADEMARK OFFICE

CERTIFICATE OF CORRECTION

PATENT NO. : 5,657,565

DATED : August 19, 1997

INVENTOR(S) : Hans J. Dehli

It is certified that error appears in the above-identified patent and that said Letters Patent is hereby corrected as shown below:

In the ABSTRACT, line 8, delete "dosed" and insert --closed--;

Column 11, line 51, delete "beating" and insert --bearing--.

Signed and Sealed this

Twenty-eighth Day of October, 1997

Bruce Lehman

*Attest:*

BRUCE LEHMAN

*Attesting Officer*

*Commissioner of Patents and Trademarks*